US006300610B1

(12) United States Patent
Han et al.

(10) Patent No.: US 6,300,610 B1
(45) Date of Patent: Oct. 9, 2001

(54) MICROWAVE OVEN WITH DOOR LATCHING MEMBER

(75) Inventors: Dae-sung Han, Kyungki-do; Han-sung Kang, Suwon, both of (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/715,071

(22) Filed: Nov. 20, 2000

(30) Foreign Application Priority Data

Aug. 25, 2000 (KR) ..... 00-49442

(51) Int. Cl.[7] ..... H05B 6/68

(52) U.S. Cl. ..... 219/722; 219/723; 219/702; 219/715; 219/756; 200/50.01

(58) Field of Search ..... 219/722, 723, 219/724, 702, 715, 756; 200/50.01, 50.02, 50.12, 50.27, 51.02

(56) References Cited

U.S. PATENT DOCUMENTS 3,777,098 * 12/1973 Tapper ..... 219/722
5,235,150 * 8/1993 Buske et al. ..... 219/722
5,546,927 * 8/1996 Lancelot ..... 126/194
5,746,456 * 5/1998 Violo et al. ..... 292/146
5,818,015 * 10/1998 Lee et al. ..... 219/723

FOREIGN PATENT DOCUMENTS 1 047 119 * 1/1979 (CA) ..... 219/722
59-153032 * 8/1984 (JP) ..... 219/724

* cited by examiner

*Primary Examiner*—Philip H. Leung
(74) *Attorney, Agent, or Firm*—Robert E. Bushnell

(57) ABSTRACT

A microwave oven comprises a main casing with a cooking chamber, a door for opening and closing the cooking chamber, and a magnetron in the main casing, for heating food within the cooking chamber. The microwave oven further comprises a power supply part; a plurality of contact parts provided to the main casing to be spaced from each other, being electrically connected to the power supply part; and a conductive part provided at the door, being electrically connected to the contact parts. With this configuration, the necessary components are decreased in number and the circuit is simplified in structure, thereby saving the cost of production and further improving the stability of the circuit.

19 Claims, 5 Drawing Sheets

MICROWAVE OVEN WITH DOOR LATCHING MEMBER

CLAIM OF PRIORITY

This application makes reference to, incorporates the same herein, and claims all benefits accruing under 35 U.S.C. §0119 from my application MICROWAVE OVEN filed with the Korean Industrial Property Office on Aug. 25, 2000 and there duly assigned Serial No. 49442/2000.

1. Technical Field

This invention relates in general to microwave ovens, and more particularly, to a microwave oven with a configuration simplified by decreasing the number of necessary components.

2. Description of the Related Art

FIG. 4 is an exploded perspective view partially showing a conventional microwave oven, and FIG. 5 is a detailed circuit diagram specifically showing a conventional door safety device. Referring to these figures, a conventional microwave oven is comprised of a main casing 101 having a cooking chamber 103 and an electronic component chamber 105, a door 107 for opening and closing a front part of the cooking chamber 103, and a control panel 109 provided in the main casing 101, for operating a number of components in the microwave oven. In the component chamber 105 are provided a high-voltage transformer 131 generating a high-voltage based on an electric power supplied from a power supply part 130, and a magnetron 133 generating electromagnetic waves based on the high-voltage generated by the high-voltage transformer 131.

The microwave oven 107 is equipped with a safety device to prevent the electromagnetic waves from being supplied into the cooking chamber 103 while the door is being opened. The safety device is comprised of a latch member 113 mounted at the door 107 so as to be engaged with a pair of hook holes 111 provided in a front wall part of the cooking chamber 103, and safety switches which are switched on and off depending upon the opening and closing of the door 107. The latch member 113 includes a pair of hooks 115 fitted into the hook holes 111; and the safety switches include a first door switch 145, a second door switch 147 and a pair of monitor switches 149.

Hereinafter, the conventional safety device for the door will be described in more detail with reference to a detailed circuit diagram shown in FIG. 5.

The conventional microwave oven has the power supply part 130, the high-voltage transformer 131 generating the high-voltages based on the electric power supplied from the power supply part 130, and the magnetron 133 generating electromagnetic waves generated based on the high-voltage from the high-voltage transformer 131. Referring to the illustrated circuit diagram, a first current line L2 and a second current line L3 are respectively provided on both ends of a primary coil of the high-voltage transformer 131. A common current line L1 is installed between the first and second current lines L2 and L3, forming a closed loop by being combined with the lines L2 and L3.

On the common current line L1 are provided the power supply part 130, and a fuse 135 for cutting off overcurrent. Between the common current line L1 and the first current line L2, a lamp 137 for illuminating the inside of the cooking chamber 103 and a fan motor 139 are connected in parallel with each other. The monitor switches 149 are respectively provided between the common current line L1 and the first current line L2, and the common current line L1 and the second current line L3, respectively. The monitor switches 149 are closed when the door is being opened whereas they are opened when the door is closed.

With this configuration, the first door switch 145 and the second door switch 147 are opened when the door is opened, thereby cutting off the electric power supplied into the magnetron 133. Consequently, the electromagnetic waves from the magnetron 133 cannot be generated while the door is being opened.

In the conventional microwave oven equipped with such a safety device, in order to provide a more effective safety device, it would be necessary to reduce the number of the safety switches and have a simplified configuration of the circuit. In a word, it is needed to save the cost of production and avoid the complexity of the circuits' configuration.

SUMMARY OF THE INVENTION

Therefore, the present invention has been made in view of the above needs, and it is an object of the present invention to provide a microwave oven having a configuration of circuits simplified by decreasing the number of switches.

This and other objects of the present invention may be achieved by a provision of the microwave oven comprising a main casing with a cooking chamber, a door for opening and closing the cooking chamber, and a magnetron in the main casing, for heating food within the cooking chamber, the microwave oven further comprising a power supply part; a plurality of contact parts provided to the main casing to be spaced from each other, being electrically connected to the power supply part; and a conductive part provided at the door, being electrically connected to the contact parts.

Preferably, the conductive part and the contact parts are electrically disconnected when the cooking chamber is opened, to prevent the electric power from the power supply part from being supplied into the magnetron.

More effectively, the microwave oven further comprises a latch member having a plurality of hook holes formed in a front wall part of the cooking chamber, and a plurality of hooks provided at the door, being fitted into the respective hook holes, and the conductive part is provided inside the latch member so as to be exposed from the hooks toward the contact parts.

More preferably, on the conductive part or the contact parts are provided elastic members capable of elastically deformed in a transverse direction relative to opening and closing of the door, and the elastic member are comprised of a plate spring contacting with the contact parts.

BRIEF DESCRIPTION OF THE DRAWINGS

A more complete appreciation of the invention, and many of the attendant advantages, thereof, will be readily apparent as the same becomes better understood by reference to the following detailed description when considered in conjunction with the accompanying drawings in which like reference symbols indicate the same or similar components, and wherein.

DETAILED DESCRIPTION OF THE PREFERRED EMBODIMENTS

Figure 1:
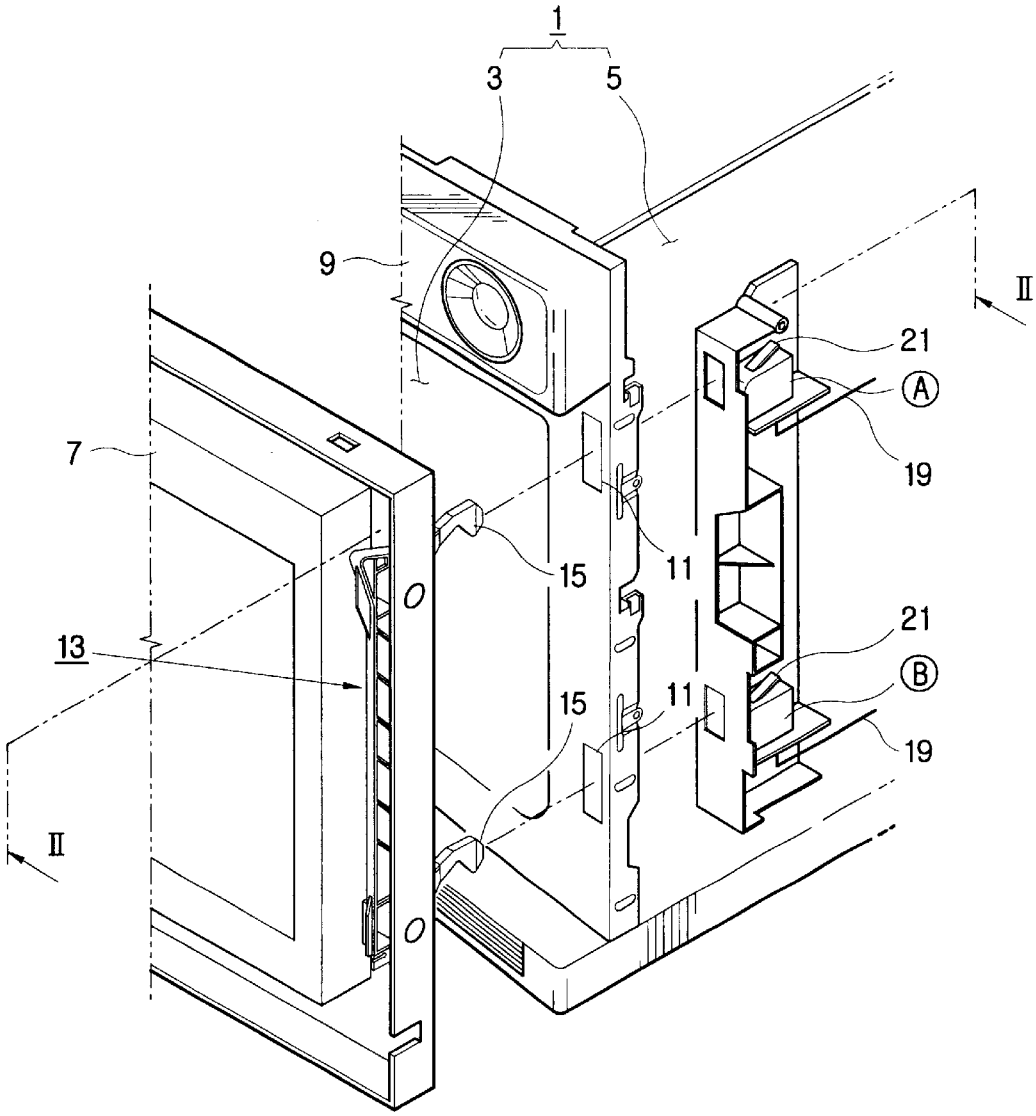
FIG. 1 is an exploded perspective view partially showing a microwave oven according to the present invention.
Figure 2:
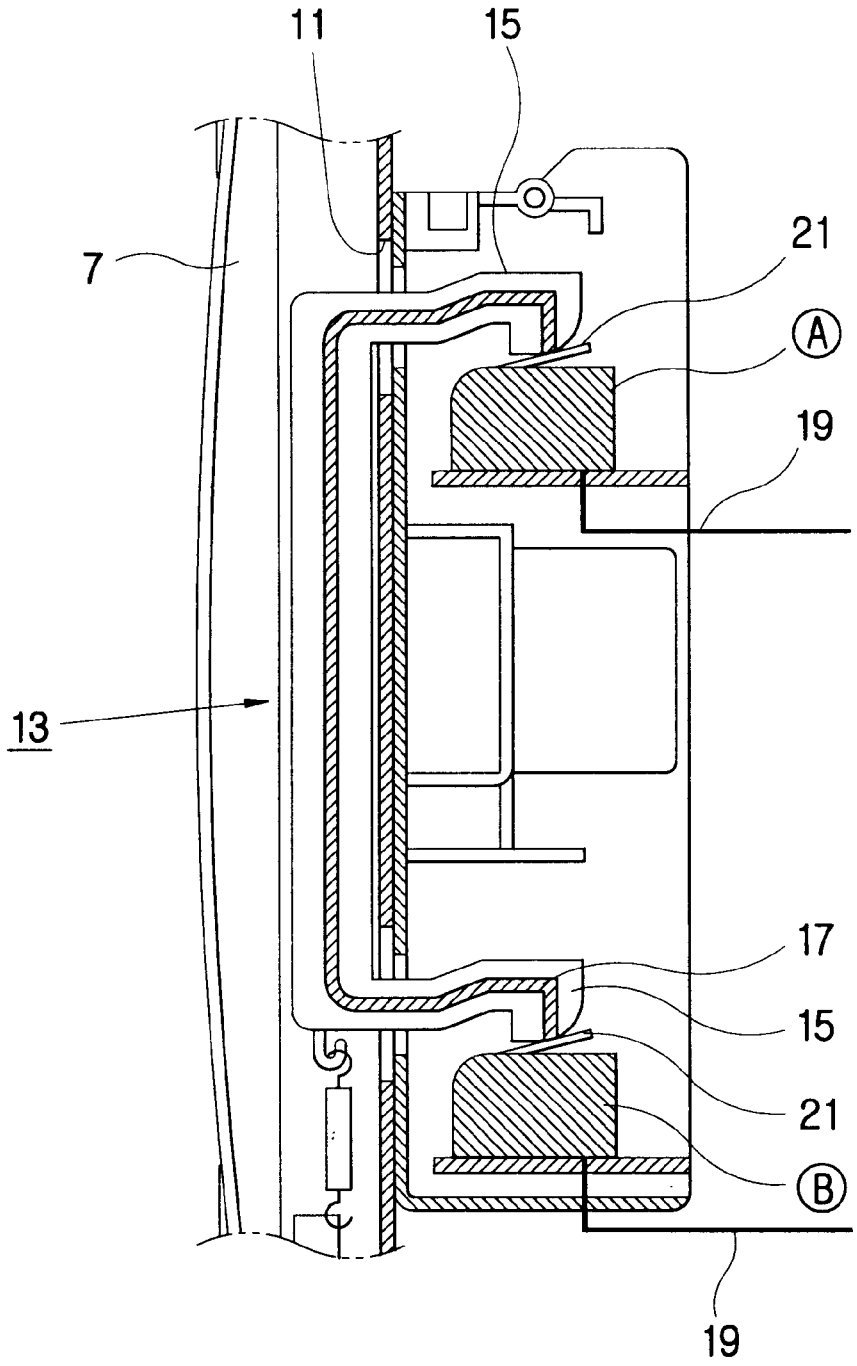
FIG. 2 is a sectional view showing the microwave oven, taken along line II—II of FIG. 1.

Referring to FIGS. 1 and 2 showing a microwave oven according to the present invention, the microwave oven is comprised of a main casing 1 partitioned into a cooking chamber 3 into which food to be cooked is put and a component chamber 5 in which a number of devices and components are mounted, a door 7 opening and closing the front part of the cooking chamber 3, and a control panel 9 provided in front of the component chamber 5, for operating the devices and components.

The microwave oven is provided with a safety device to prevent the electromagnetic waves from being supplied into the cooking chamber 3 while the door is being opened. In the component chamber 5 are provided electronic components such as a high-voltage transformer and a magnetron, etc. to be described later.

As illustrated in FIGS. 1 and 2, the safety device includes a latch member 13 mounted on the door 7 to be fitted into a pair of hook holes 11 provided in a front wall part of the cooking chamber 3, and a pair of contact parts A and B provided in the main casing 1, contacting at least a part of the latch member 13 according to opening and closing of the door 7. The latch member 13 has a pair of hooks 15 to be fitted into the pair of hook holes 11, and a conductive part 17 is provided inside the latch member 13. Opposite ends of the conductive part 17 are exposed outside from the hooks 15 and contact the contact parts A and B at the opposite ends thereof, thereby being electrically connected to the contact parts A and B. In the contact parts A and B are provided a pair of wires 19 being electrically connected to the components such as the magnetron, the high-voltage transformer, etc.

Either of the contact parts A and B or the conductive part 17 provided in the latch member 13 is provided with a pair of elastic members 21 which are capable of being elastically deformed in the transverse direction relative to opening and closing of the door 3. The elastic members are designed to allow the contact parts A and B and the conductive part 17 to be easily contacted. In the present embodiment, a plate spring is used as each elastic member 21. As depicted in FIG. 2, the plate springs 21 are disposed on the contact parts A and B, respectively. An electric contact between the conductive part 17 and the contact parts A and B is facilitated by allowing the hooks 15 of the latch member 13 to press upon the plate springs 21.

Figure 3:
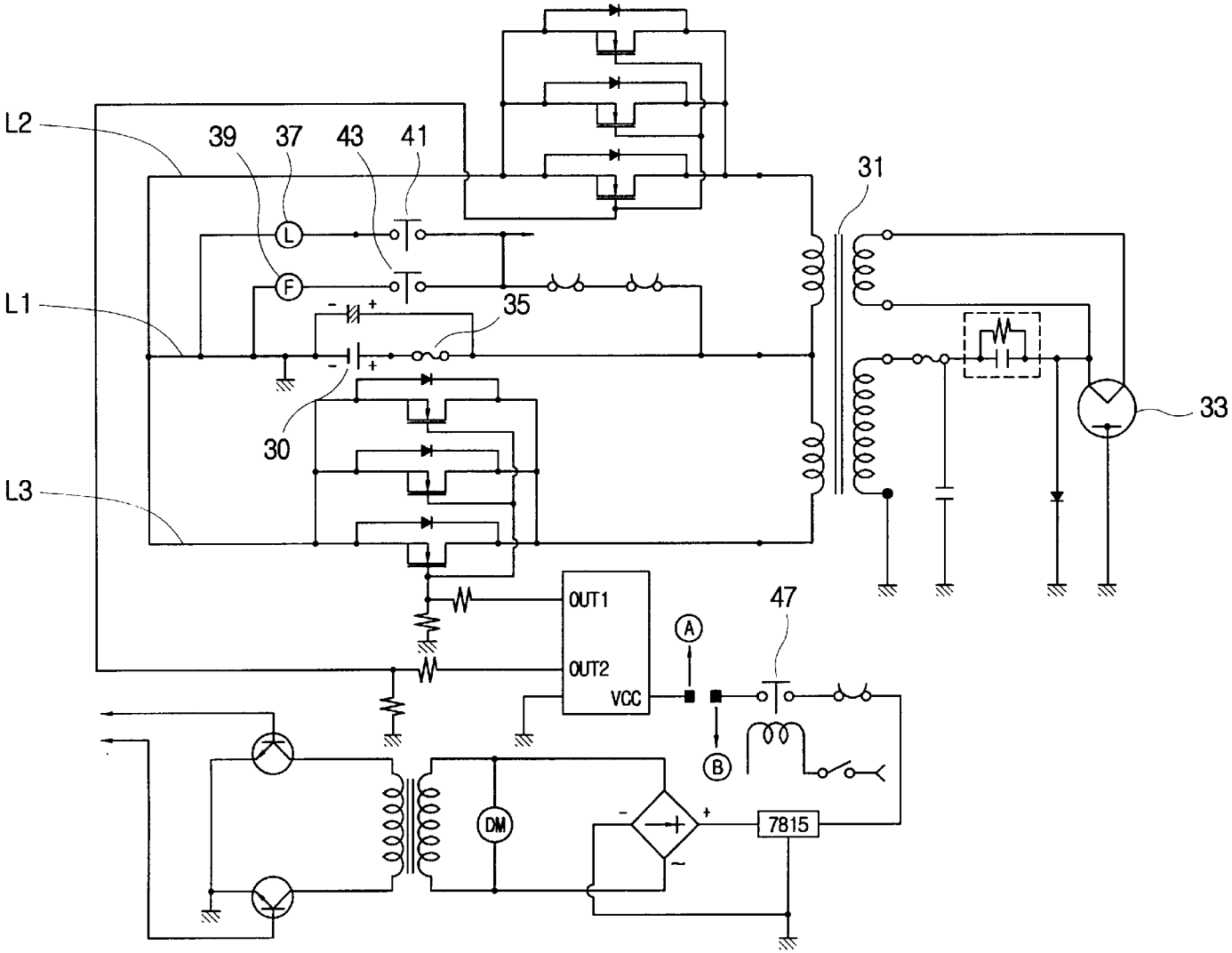
FIG. 3 is a detailed circuit diagram of a door safety device according to the present invention.
Figure 4:
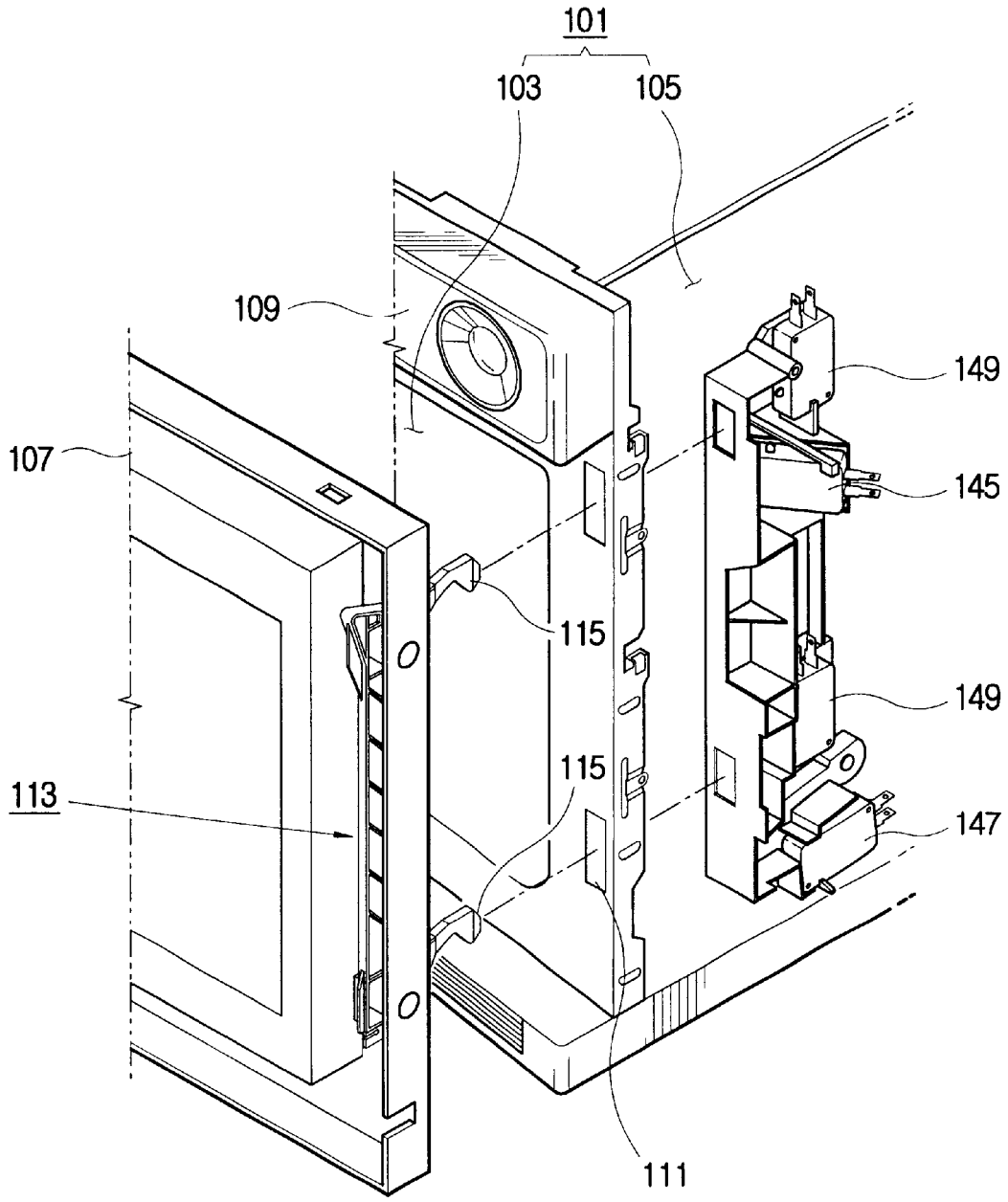
FIG. 4 (PRIOR ART)
FIG. 4 is an exploded perspective view partially showing a conventional microwave oven.
Figure 5:
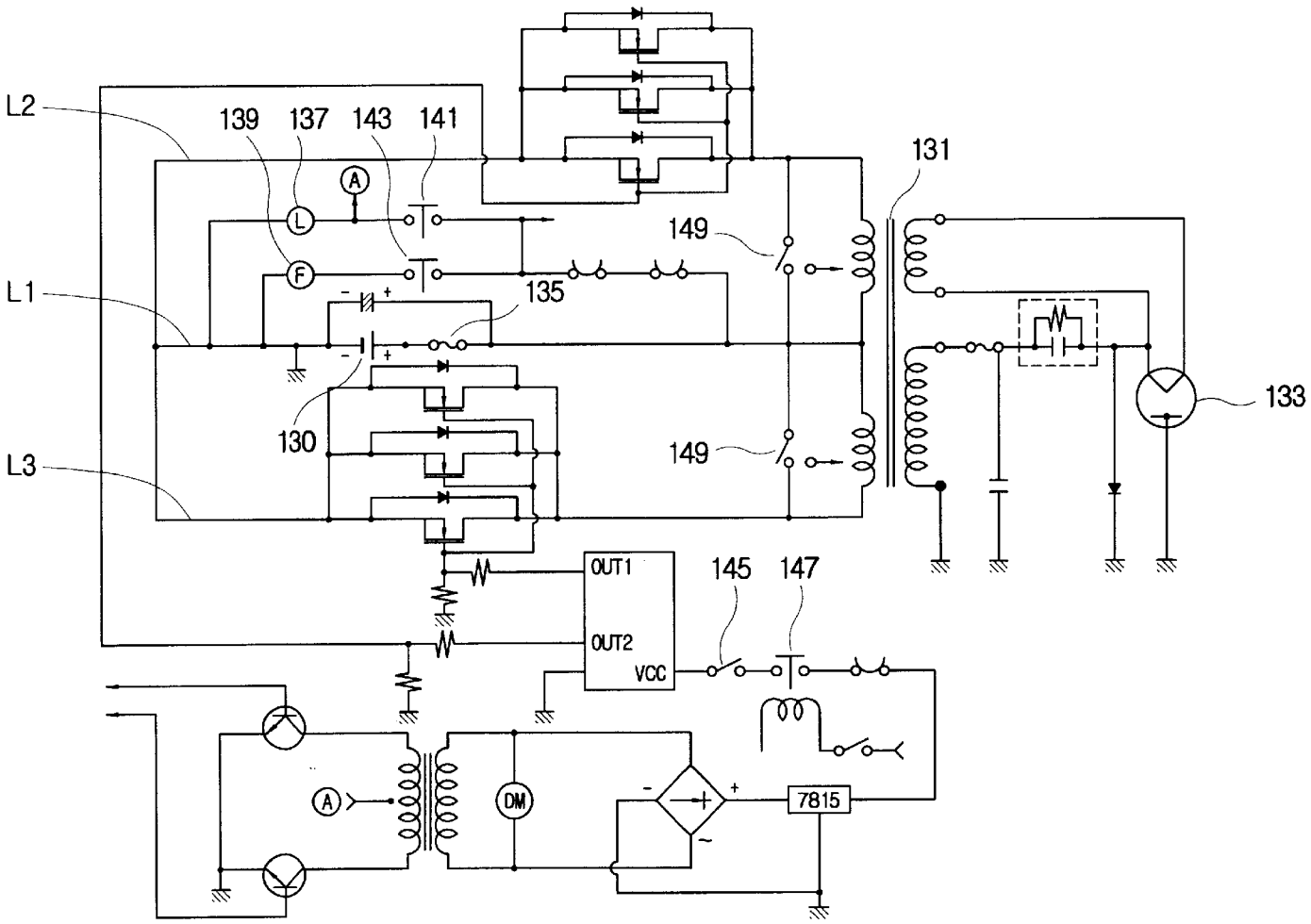
FIG. 5 (PRIOR ART)
FIG. 5 is a detailed circuit diagram of a conventional door safety device.

Hereinafter, the door safety device according to the present invention will be described in more detail, referring to FIG. 3 which is a detailed circuit diagram of the door safety device.

The microwave oven having the safety device according to the present invention is comprised of a power supply part 30 supplying an electric power to the microwave oven, a high-voltage transformer 31 generating high-voltages based on the electric power supplied from the power supply part 30, a current line connecting the power supply part 30 and the high-voltage transformer 31 and forming a closed loop supplying the electric power from the power supply part 30, and a magnetron 33 generating electromagnetic waves based on the high-voltages generated by the high-voltage transformer 31.

The current line includes a first current line L2 and a second current line L3 connected to a primary coil of the high-voltage transformer 31, and a common current line L1 between the first current line L2 and the second current line L3, forming the closed loop together with the first and second current lines L2 and L3.

On the common current line L1 are provided the power supply part 30 supplying the electric power, and a fuse 35 preventing the overcurrent from being supplied into the magnetron 33 and load circuits, etc. On a closed loop (hereinafter, "first closed loop") formed by the first current line L2 and the common current line L1, a lamp 37 illuminating the cooking chamber 3 and a fan motor 39 driving a fan (not shown) are connected in parallel with each other. On the first closed loop, a switch 41 is connected in series to the lamp 37 for controlling the operation of the lamp 37, and a switch 43 connected in series to the fan motor 39 for controlling the operation of the fan motor 39.

On the current line are provided the contact parts A and B contacting the conductive part 17 provided in the door 7 so as to be electrically connected, for supplying the electric power from the power supply part 30 to the magnetron 33. On the current line is provided a relay switch 47 for short-circuiting the electric power from the power supply part 30 according to the user's operation. In the detailed circuit diagram of FIG. 3, there are further shown a low-voltage transformer, a temperature sensor, and a detector for detecting opening and closing of the door, and a field effect transistor(FET), etc, whose description will be omitted for the sake of convenience.

With this configuration, when the door 7 of the microwave oven is closed, the hooks 15 of the latch member 13 provided in the door 3 passes through the hook holes 11 provided in the front wall part of the cooking chamber 3. The plate springs 21 provided on the contact parts A and B easily perform an electrical connection of the conductive part 17 in the hooks 15 with the contact parts A and B. When the door 7 is opened, the conductive part 17 and the contact parts A and B are disconnected, thereby preventing the electric power from being supplied into the magnetron 33. In other words, the electric power into the magnetron 33 can be supplied or cut off according to connection or disconnection of the contact parts A and B and the conductive part 17.

The number of components to be employed in the microwave oven can be decreased by comprising a power supply part, the contact parts spaced from the main casing and electrically connected to the power supply part, and the conductive part provided in the door, being electrically connected by contacting the contact parts. Additionally, the cost of production can be lowered; and the circuit's structure can be simplified.

In the above description, the latch member having the conductive part and contact parts being electrically connected to the conductive part have been described. However, the contact parts can be provided in the front wall part of the cooking chamber contacting with the door by providing the conductive part in the door, without the latch member.

In the present embodiment, the elastic members are provided on the contact parts. However, the elastic member can be provided to the conductive part. It has also been described that the plate spring is used as the elastic member. In addition, a coil spring or a roller having a conductor can be used as the elastic member.

The pair of contact parts and conductive parts electrically connected to the respective contact parts are provided according to the above-described embodiment, but two or more contact parts and conductive parts can be provided.

As described above, according to the present invention, the number of necessary components may be decreased, thereby saving the cost of production. The circuits' structure may be simplified, thereby decreasing the rate of fault and improving the stability of the circuit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven, comprising:

a main casing having a cooking chamber, a component chamber, an outer wall of said component chamber, and a pair of hook holes formed on said outer walls;

a door coupled to said main casing for opening and closing said cooking chamber:

a latch member having a rod and a pair of hooks, said hooks extended from both ends of said rod and protruding from said door toward said outer wall of said component chamber while said rod is disposed inside said door, said hooks disposed to be fitted into respective hook holes;

a conductor provided inside both said rod and said hooks of said latch member and having two end contacts exposed from each end surface of said protruded hooks; and a pair of switches disposed inside said component chamber of said main casing to contact each corresponding end contact of said conductor when said hooks pass through said respective hook holes and protrude inside said component chamber, said switches having a conductive elastic member contacting corresponding end contact of said conductor, thereby being electrically connected to a power supply part.

2. The microwave oven of claim 1, wherein said conductor and said switches are electrically disconnected from said power supply part when said cooking chamber is opened.

3. The microwave oven of claim 1, wherein with said conductive elastic members capable of elastically deformed in a transverse direction relative to opening and closing of said door.

4. The microwave oven of claim 3, wherein said conductive elastic members are comprised of a plate spring contacting each corresponding end contact of said conductor.

5. The microwave oven of claim 1, with said conductor enclosed by said rod and aid hooks without being exposed outside said rod and said hooks except said end contracts formed on each end of said conductor.

6. The microwave oven of claim 1, with said end contacts of said conductor contacting said corresponding switch while said hooks hold said door in a colosed position for closing said cooking chamber.

7. The microwave oven of claim 1, with said switches spaced-apart from said outer wall of said component chamber.

8. The microwave oven of claim 1, with said end contacts of said conductor spaced-apart from said outer wall while said hooks pass through said hook holes and protrude inside said component chamber from said outer wall.

9. The microwave oven of claim 1, with said hooks having a distal end being oblique with respect to said outer wall, said end surface of said distal end being oblique with respect to said outer wall.

10. The microwave oven of claim 1, with said hooks having a distal end parallel to said outer wall, said end surface of said distal end disposed inside of said component chamber to contact respective switches when said door is in a closed position.

11. The microwave oven of claim 1, wherein said end surface of said protruded hooks is not parallel to said outer wall.

12. The microwave oven of claim 1, wherein said end contacts of said conductor do not exposed to a plane parallel to said outer wall.

13. A door latch member in an oven, comprising:

said oven having a cooking chamber, a component chamber, a front wall of said component chamber, a plurality of holes formed on said front wall;

a door for opening and closing said cooking chamber;

a latch member holding said door in a closed position when said cooking chamber is closed, said latch member having a rod and a plurality of hooks extended from said rod, said hooks protruding from said door while said rod is disposed inside said door;

a distal end formed on each hooks, disposed inside said component chamber when said hooks pass through said respective holes of said front wall;

a conductor disposed inside said rod and said hooks of said latch member, having end contacts exposed from each end surface of said distal end; and a plurality of switches disposed inside said component chamber to contact said respective end contacts of said conductor.

14. The door latch member of claim 13, with said distal end of said hooks being oblique with respect to said front wall.

15. The door latch member of claim 13, with said end surface of said distal end being oblique with respect to said front wall.

16. The door latch member of claim 13, wherein said distal ends are not perpendicular to said front wall while said end surface of said distal ends is not parallel to said front wall.

17. The door latch member of claim 13, with said end contacts of said conductor having a plane which is not parallel to said front wall.

18. The door latch member of claim 13, with said switches spaced-apart from said front wall.

19. The door latch member of claim 13, with said distal end of said hooks spaced-apart from said front wall when said door closes said cooking chamber.

* * * * *